US005131195A

United States Patent [19]

Bellavista

[11] Patent Number: 5,131,195

[45] Date of Patent: Jul. 21, 1992

[54] EARTHQUAKE-RESISTANT INSULATOR FOR BUILDINGS

[76] Inventor: Patrice Bellavista, Lycee Frederic-Mistral, Rue d'Annanelle, Avignon F84000, France

[21] Appl. No.: 582,888

[22] PCT Filed: Jan. 26, 1990

[86] PCT No.: PCT/FR90/00056

§ 371 Date: Oct. 12, 1990

§ 102(e) Date: Oct. 12, 1990

[87] PCT Pub. No.: WO90/09499

PCT Pub. Date: Aug. 23, 1990

[30] Foreign Application Priority Data

Feb. 10, 1989 [FR] France ..... 89 01928

[51] Int. Cl.[5] ..... E04H 9/02

[52] U.S. Cl. ..... 52/167 R; 52/573

[58] Field of Search ..... 52/167, 573, 167 R; 248/609, 634, 638, 678

[56] References Cited

U.S. PATENT DOCUMENTS

| | | | |
|---|---|---|---|
| 4,679,761 | 7/1987 | Small | 248/609 |
| 4,727,695 | 3/1988 | Kemeny | 52/167 |
| 4,942,703 | 7/1990 | Nicolai | 248/609 |

FOREIGN PATENT DOCUMENTS

| | | | |
|---|---|---|---|
| 367843 | 8/1982 | Australia . | |
| 2217768 | 9/1973 | Fed. Rep. of Germany | 52/167 |
| 2828714 | 1/1980 | Fed. Rep. of Germany . | |
| 2515718 | 5/1983 | France . | |
| 2601716 | 1/1988 | France . | |
| 2625763 | 7/1989 | France . | |
| 526806 | 9/1940 | United Kingdom | 248/604 |
| 835141 | 5/1960 | United Kingdom | 248/634 |

*Primary Examiner*—James L. Ridgill, Jr.
*Attorney, Agent, or Firm*—Sandler, Greenblum & Bernstein

[57] ABSTRACT

Earthquake-resistant insulator for buildings includes two separate single-block units made form a hard, rot-resistant material having a high resistance to abrasion for connection to a the infrastructure and superstructure of a building. More specifically, the insulator includes a lower unit composed of a horizontal circular friction plate having a truncated cone at its center, and an upper unit composed of a circular cap with a downward-turned concavity covering the lower unit such that the bottom of the concavity rests on the top of the truncated cone and lower edges on the friction plate of the lower unit. An annular space is provided between the lateral wall of the upper unit and the lateral walls of the truncated cone of the lower unit making relative lateral movement possible. At least one collar, also made from a rot-resistant material and having high shock-absorbing features, is positioned in the annular space located between the two units. The insulator is designed for insertion between the ground and the buildings, and is constructed with a view to making the building capable of withstanding the most violent seismic shocks.

20 Claims, 1 Drawing Sheet

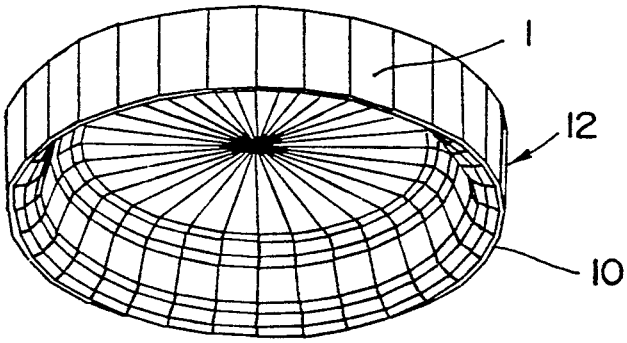
Fig- 1
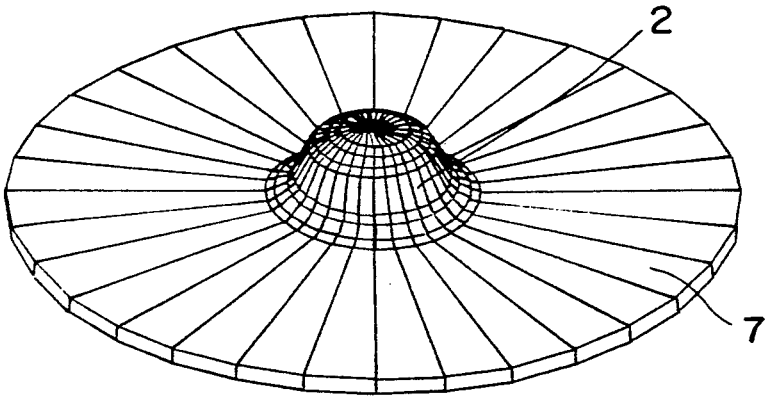
Fig- 2
Fig- 3
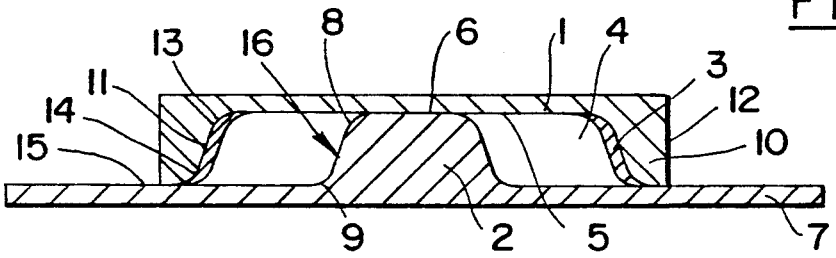
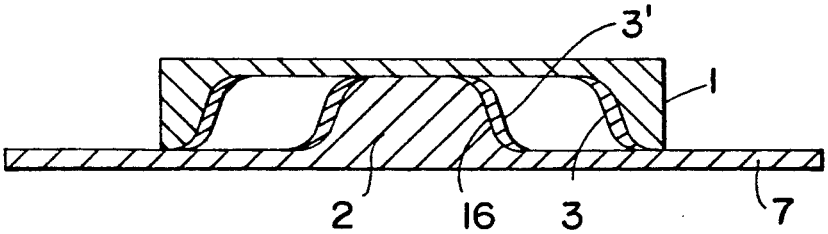
Fig- 4
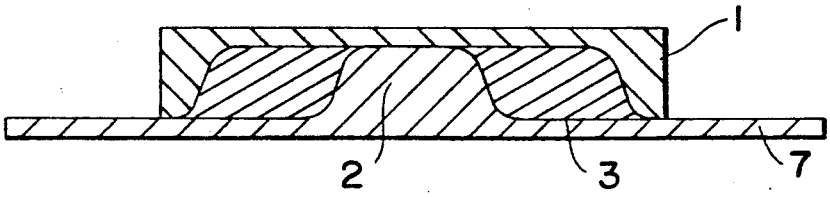
Fig- 5

EARTHQUAKE-RESISTANT INSULATOR FOR BUILDINGS

BACKGROUND OF THE INVENTION

1. Field of the Invention

The present invention is directed to an earthquake-resistant insulator for buildings.

Earthquakes resistant insulators are designed to be interposed between the ground and erected buildings so as to allow these constructions to avoid the most violent effects of earthquakes.

2. Discussion of Background and Relevant Material

Earthquake-resistant apparatus that are presently known are of two different types. They are either based on a friction sliding possibility allowing limited movement or conceived from elastomer bases often hooped, whose distortion is put to use. Attention is directed to French Patent Nos. 2,625,763 and 2,601,716 by the same inventor. In these apparatus the movement of the building is not absorbed, and strong lateral movements can create extremely hard shocks that could cause breaking of the earth tremor apparatus or induce their characteristic to change over time. Logically, this would necessitate their periodic replacement. Moreover these known apparatus do not allow control of the amplitude of movements due to earth tremors.

SUMMARY OF THE INVENTION

The apparatus according to the present invention gets rid of the drawbacks associated with conventional earthquake resistant insulators. Indeed, the apparatus according to the present invention allows absorption of both lateral and vertical movements that an earthquake creates, as well as control of the amplitude of these movements. Furthermore, they are made of extremely stable and durable materials which are strongly resistant to differences in temperature, microorganisms and chemical aggressions.

The present invention is constituted by the combination of two independent monoblock elements made of hard, rot resistant material, with high resistance to abrasion, with these elements being respectively interdependent to the infrastructure and the superstructure of the building. The lower element being is constituted by a horizontal friction plate, preferably circular, having at its center a truncated cone. The upper element is constituted of a circular cap with is concavity turned towards the lower elements, and covering the lower element so that the bottom of the concavity rests on the top of the truncated cone and the lower edges of the friction plate of the lower element. An annular space is provided between the lateral walls of the upper element and the truncated cone of the lower element allowing a relative lateral movement. Moreover, at least one absorbing collar made of a material that is also rot resistant and possessing high shock absorption characteristics is connected to the inside lateral wall of the upper element and/or of the lateral wall of the truncated cone of the lower element, and fills all or part of the annular space located between the two elements.

BRIEF DESCRIPTION OF THE DRAWINGS

In the annexed drawings, given by way of a nonlimiting example of one of the embodiments of the object of the invention:

FIGS. 1 and 2 show views in perspective of the separated upper and lower elements, respectively.

FIGS. 3, 4 and 5 represent cross sectional views of three embodiments of the assembled apparatus.

DETAILED DESCRIPTION OF THE PREFERRED EMBODIMENTS

The apparatus illustrated in FIGS. 1–5 comprises an upper element 1 in the form of a cylindrical cap having a flat bottom and a hollow part which is directed towards the bottom, dependent on the superstructure of the building, of a base or truncated cone 2 dependent on the carrying surface, and of one or two absorbing collars 3, 3' connected to the two elements 1, 2, and located in an annular space 4 between the lower truncated cone and the upper cap 1.

These two elements being separated, the upper element 1 is movable under the effect of a tremor, while the lower element is affixed on a foundation. An interconnecting space 4 separates these two elements, with the upper element 1 being movable in case of a tremor, and the lower element 2 remaining fixed. The lower element 2 comprises at its base a horizontal friction plate 7 on which the lower edge 10 of upper element 1 rests. Angles 8, 9 of the lateral wall 16 of base 2 with its upper section 6 and with plate 7 are rounded so as to avoid the starting point of a fracture or of a scraping effect during lateral movements. For the same reasons, angles 13, 14, 15 formed by the internal lateral wall 11 and external wall 12 of the upper element 1 with bottom 5 and the lower edge 10 are also rounded.

the absorbing collar 3 is connected to the internal lateral wall 11 of the upper element 1; whereas, collar 3' is connected to lateral wall 16 of the inferior base 2. These two collars can be replaced by a single one, connected to lateral walls 11, 16 of the upper and lower elements, or one of the two, and filling the totality of the interconnecting annular space 4.

The interconnecting annular space 4 can be as small as several tens of centimeters, and can be adapted to the dimensions centimeters, or as large as of the building to be protected.

the dimension of contact surfaces 10, 6 of upper element 1 and lower element 2 are adaptable in each type of construction.

All the parts of the apparatus are made of a rot resistant material with stable characteristics over time, preferably polyurethane. For the upper element 1 and lower element 2, the material used should have a shore hardness A greater than to 90, a resilience greater than 40%, a resistance to contraction greater than 50 MPa and a resistance to abrasion greater than 55 mg/mm, whereas for the absorbing collars 3, 3', the shore hardness A should be less than 50, the resilience less than to 5%, the breaking elongation greater than 500% and the shock absorption greater than 95%.

The positioning of the various constitutive elements maximize the useful effects of this apparatus that were not obtained to this day with similar apparatus.

I claim:

1. An earthquake-resistant insulator for building capable of being interposed between the ground and erected buildings to permit a building to avoid effects of violent earth tremors by absorbing vertical as well as lateral movements caused by tremors, and to control and reduce the amplitude of these movements, comprising two independent monoblock elements composed of a hard, rot resistant material, possessing high resistance to abrasion;

said two independent monoblock elements comprising, a lower element including a horizontal friction plate having at its center a truncated cone, and an upper element including a circular cap with a flat bottom and a concavity directed towards and covering said lower element so that said flat bottom rests on an uppermost portion of said truncated cone and lower edges of said circular cap on said friction plate of said lower element;

an annular space between a lateral wall portion of said upper element and an opposing lateral wall portion of said truncated cone of said lower element allowing relative lateral movement; and at least one absorbing collar composed of a material that is rot resistant and possesses high shock absorption characteristics, said at least one absorbing collar being mounted on at least one of said lateral wall portion of said upper element and said opposing lateral wall portion of said truncated cone of said lower element, and filling at least a portion of said annular space.

2. The apparatus according to claim 1, comprising an absorbing collar connected to said lateral wall portion of said upper element, and another absorbing collar connected to said opposing lateral wall portion of said lower element.

3. The apparatus according to claim 1, wherein said annular space is completely filled by said at least one absorbing collar, and said at least one absorbing collar is connected to at least one of said lateral wall portion of said upper element and said opposing lateral wall portion of said truncated cone of said lower element.

4. The apparatus according to claim 1, wherein angles of said lateral wall portion of said upper element, and angles of said opposing lateral wall portion of said lower element, and angles between said bottom and said lower edge are rounded to avoid starting points of fracture and scraping effects during lateral movements.

5. The apparatus according to claim 1, wherein all angles are rounded to avoid starting points of fracture and scraping effects during lateral movements.

6. The apparatus according to claim 1, wherein said horizontal friction plate is circular.

7. The apparatus according to claim 1, wherein said upper element and said lower element are composed of rot resistant material having stable characteristics over time, and have a shore hardness A greater than 90, a resilience greater than 40%, a resistance to traction greater than 50 MPa, and a resistance to abrasion greater than to 55 mg/mm.

8. The apparatus according to claim 7, wherein said upper element and said lower element are composed of polyurethane.

9. The apparatus according to claim 1, wherein said at least one absorbing collar is composed of rot resistant material having stable characteristics over time, and has a shore hardness A less than 50, a resilience less than 5%, a breaking elongation greater than 500%, and shock absorption greater than 95%.

10. The apparatus according to claim 9, wherein said upper element and said lower element are composed of polyurethane.

11. An earthquake-resistant insulator comprising, a lower element composed of hard, rot resistant material and possessing high resistance to abrasion, said lower element including a horizontal friction plate having at its center a truncated cone;

an upper element composed of hard, rot resistant material and possessing high resistance to abrasion, said upper element including a circular cap with a flat bottom and a concavity directed towards and covering said lower element so that said flat bottom rests on an uppermost portion of said truncated cone and lower edges of said circular cap rest on said friction plate of said lower element;

an annular space between a lateral wall portion of said upper element and an opposing lateral wall portion of said truncated cone of said lower element allowing relative lateral movement; and at least one absorbing collar composed of a material that is rot resistance and possesses high shock absorption characteristics, said at least one absorbing collar being connected to at least one of said lateral wall portion of said upper element and said opposing lateral wall portion of said truncated cone of said lower element, and filling at least a portion of said annular space.

12. The apparatus according to claim 11, comprising an absorbing collar connected to said lateral wall portion of said upper element, and an absorbing collar connected to said opposing lateral wall portion of said lower element.

13. The apparatus according to claim 11, wherein said annular space is completely filled by said at least one absorbing collar, and said at least one absorbing collar is connected to at least one of said lateral wall portion of said upper element and said opposing lateral wall portion of said truncated cone of said lower element.

14. The apparatus according to claim 11, wherein angles of said lateral wall portion of said upper element, and angles of said opposing lateral wall portion of said lower element, and angles between said bottom and said lower edge are rounded to avoid starting points of fracture and scraping effects during lateral movements.

15. The apparatus according to claim 11, wherein all angles are rounded to avoid starting points of fracture and scraping effects during lateral movements.

16. The apparatus according to claim 11, wherein said horizontal friction plate is circular.

17. The apparatus according to claim 11, wherein said upper element and said lower element are composed of rot resistant material having stable characteristics over time, and have a shore hardnesses A greater than 90, a resilience greater than 40%, a resistance to traction greater than 50 MPa, and a resistance to abrasion greater than to 55 mg/mm.

18. The apparatus according to claim 17, wherein said upper element and said lower element are composed of polyurethane.

19. The apparatus according to claim 11, wherein said at least one absorbing collar is composed of rot resistant material having stable characteristics over time, and has a shore hardness A less than 50, a resilience less than 5%, a breaking elongation greater than 500%, and shock absorption greater than 95%.

20. The apparatus according to claim 19, wherein said upper element and said lower element are composed of polyurethane.

* * * * *